US010401111B2

(12) United States Patent
Brittingham et al.

(10) Patent No.: US 10,401,111 B2
(45) Date of Patent: Sep. 3, 2019

(54) MODULAR FIREARM SUPPRESSOR

(71) Applicant: Q LLC, Portsmouth, NH (US)

(72) Inventors: Kevin Brittingham, Portsmouth, NH (US); Ethan Lessard, East Kingston, NH (US); Brian McDonald, Portsmouth, NH (US)

(73) Assignee: Q, LLC, Portsmouth, NH (US)

( * ) Notice: Subject to any disclaimer, the term of this patent is extended or adjusted under 35 U.S.C. 154(b) by 0 days.

(21) Appl. No.: 15/630,349

(22) Filed: Jun. 22, 2017

(65) Prior Publication Data

US 2018/0202742 A1 Jul. 19, 2018

Related U.S. Application Data

(60) Provisional application No. 62/446,125, filed on Jan. 13, 2017.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
See application file for complete search history.

(56) References Cited

U.S. PATENT DOCUMENTS

| | | | | |
|---|---|---|---|---|
| 2,847,888 | A * | 8/1958 | Paulson | B25B 13/48 81/90.4 |
| 5,247,715 | A | 9/1993 | Nishiguchi | |
| D371,287 | S | 7/1996 | Gilbert, Jr. | |
| 7,272,996 | B2 | 9/2007 | Pontieri | |
| 8,100,224 | B1 * | 1/2012 | Olson | F41A 21/30 181/212 |
| 8,439,155 | B2 | 5/2013 | Shults et al. | |
| 8,499,676 | B1 | 8/2013 | Moore et al. | |
| 8,516,941 | B1 * | 8/2013 | Oliver | F41A 21/30 181/223 |
| 8,555,765 | B2 | 10/2013 | Graham et al. | |

(Continued)

OTHER PUBLICATIONS

"Stuck suppressor—need ideas | Sniper's Hide Forum", http://forum.snipershide.com/threads/stuck-suppressor-need-ideas.66820 (Year: 2011).*

(Continued)

*Primary Examiner* — Joshua T Semick
(74) *Attorney, Agent, or Firm* — Fox Rothschild LLP

(57) ABSTRACT

A modular suppressor kit includes a modular suppressor and suppressor tool. The modular suppressor includes a barrel attachment portion that has a central passage. The barrel attachment portion is configured to attach to a firearm barrel. The modular suppressor includes a cap portion that has a central passage. The modular suppressor includes a body portion that has an internal baffle structure and an expansion chamber. The body portion is attachable to, and separable from, the barrel attachment portion and the cap portion. The body portion defines a central passage that is alignable with the central passage of the barrel attachment portion and the central passage of the cap portion. The suppressor tool has an engagement feature for engaging with at least one of the barrel attachment portion, cap portion, and body portion.

8 Claims, 18 Drawing Sheets

(56) References Cited

U.S. PATENT DOCUMENTS

| | | | | |
|---|---|---|---|---|
| D718,103 | S | 11/2014 | Geissele | |
| 9,175,920 | B2 * | 11/2015 | Moore | F41A 21/44 |
| 9,476,661 | B2 * | 10/2016 | Troy | F41A 21/30 |
| 9,500,427 | B1 * | 11/2016 | Larue | F41A 21/30 |
| 9,631,888 | B2 | 4/2017 | Young | |
| 9,709,354 | B2 * | 7/2017 | Larue | F41A 21/30 |
| 9,746,267 | B2 * | 8/2017 | Smith | F41A 21/30 |
| 9,816,773 | B1 * | 11/2017 | Reis Green | F41A 21/30 |
| 9,857,137 | B2 * | 1/2018 | Barrett | F41A 21/28 |
| 9,921,021 | B1 | 3/2018 | Graham | |
| 10,166,658 | B2 | 1/2019 | Bennett et al. | |
| 2008/0098880 | A1 | 5/2008 | Brugger | |
| 2012/0255807 | A1 | 10/2012 | Pieratti | |
| 2015/0198405 | A1 | 7/2015 | Keng | |
| 2017/0153080 | A1 | 6/2017 | Roberts et al. | |
| 2017/0167816 | A1 | 6/2017 | Young et al. | |
| 2017/0261281 | A1 * | 9/2017 | Salvador | F41A 21/30 |
| 2017/0299313 | A1 | 10/2017 | Adamson | |
| 2018/0038663 | A1 | 2/2018 | Larue | |
| 2018/0058791 | A1 | 3/2018 | Larue | |
| 2019/0022847 | A1 | 1/2019 | Weathers | |
| 2019/0030690 | A1 | 1/2019 | Hamby | |

OTHER PUBLICATIONS

"Washers and torque on suppressors—SilencerTalk", http://www.silencertalk.com/forum/viewtopic.php?t=93784 (Year: 2012).*

"Manufacturing of a Sonic Silencer", Sonic Silencer, YouTube, https://www.youtube.com/watch?v=ZhUlEn-pgg0 (Year: 2014).*

"Shop | StingerWorx Suppressors ", https://www.stingerworx.com/shop (Year: 2017).*

"Suppressor is stuck to my barrel. Not mechanically inclined : NFA", reddit, https://www.reddit.com/r/NFA/comments/5d2mdv/suppressor_is_stuck_to_my_barrel_not_mechanically/ (Year: 2016).*

"Suppressor Spanner Wrench—RTT Specialties LLC", http://rttspecialties.com/product/suppressor-spanner-wrench (Year: 2017).*

"Manufacturing of a Sonic Silencer", Sonic Silencers, https://www.youtube.com/watch?v=ZhUlEn-pgg0&t=221s (Year: 2014).*

YouTube Video, "Sonic 35 Modular Suppressor" at https://www.youtube.com/watch?v=eCtlrzKuECA (Nov. 13, 2013).

* cited by examiner

MODULAR FIREARM SUPPRESSOR

CROSS-REFERENCE TO RELATED APPLICATION

The present application claims the benefit of priority to U.S. Provisional Patent Application No. 62/446,125 filed Jan. 13, 2017, the disclosure of which is hereby incorporated by reference in its entirety.

BACKGROUND

Firearm suppressors are attached to the ends of firearm barrels and are used to reduce the noise, flash, and recoil of the firearm during firing. This is traditionally accomplished by reducing the speed and pressure at which propellant gases escape the barrel of the firearm after a round of ammunition is fired. In general, a series of baffles and chambers control the path of propellant gases, thereby reducing the noise and flash created by the discharging round of ammunition.

The weight of suppressors is important to the operation of the firearm to which they are attached. For example, if a suppressor is too heavy, the user may find it difficult to manipulate and operate the firearm due to its modified center of gravity.

Suppressors are typically constructed with a fixed length, limiting the user to the sound and flash reduction properties of the suppressor at that one length, as well as a possibly unwieldy length of a particular firearm with a fixed length suppressor attached. However, a user may desire to change the sound and flash reduction properties of the suppressor, and the length of a suppressed firearm, especially in different environments or circumstances in which the firearm and suppressor are to be used.

Therefore, improvements to suppressors are needed.

SUMMARY

The present disclosure relates generally to firearm suppressors. In one possible configuration, and by non-limiting example, a suppressor having a modular design is disclosed herein.

In one aspect, the disclosed technology relates to a modular suppressor kit including a modular suppressor having: a barrel attachment portion having a central passage, the barrel attachment portion being configured to attach to a firearm barrel; a cap portion having a central passage; and a body portion having an internal baffle structure and an expansion chamber, the body portion being attachable to, and separable from, the barrel attachment portion and the cap portion, wherein the body portion defines a central passage being alignable with the central passage of the barrel attachment portion and the central passage of the cap portion; and a suppressor tool having an engagement feature for engaging with at least one of the barrel attachment portion, cap portion, and body portion. In one embodiment, the barrel attachment portion, cap portion and body portion are generally cylindrical. In another embodiment, the engagement feature of the suppressor tool prevents relative movement between the suppressor tool and at least one of the barrel attachment portion, cap portion, and body portion when the suppressor tool is engaged with the at least one of the barrel attachment portion, cap portion, and body portion. In another embodiment, at least one of the barrel attachment portion, cap portion, and body portion includes at least one of a recess and a projection for receiving at least one of a projection and a recess of the suppressor tool. In another embodiment, the engagement feature of the suppressor tool is a pair of projections, and the barrel attachment portion, cap portion, and body portion include a plurality of recesses sized to receive the pair of projections. In another embodiment, the suppressor tool includes a first and a second body mated with one another, wherein the first body defines a first recess and the second body defines a second recess, wherein the engagement feature is positioned on a wall of at least one of the first and second recesses. In another embodiment, the first and second recesses combine to form a cylindrical passage when the suppressor tool is in a closed position. In another embodiment, the cap portion includes an exterior projection surrounding the central passage. In another embodiment, the suppressor tool has a cap recess that is sized to receive the exterior projection of the cap portion so as to prevent relative movement between the suppressor tool and the cap portion when the cap recess receives the exterior projection.

In another aspect, the disclosed technology relates to a suppressor tool including: a first body having a first engagement feature configured to engage with a suppressor; and a second body mated with the first body, the second body includes a second engagement feature configured to engage with a separate portion of the suppressor than the first engagement feature. In one embodiment, the suppressor tool further includes a first cap engagement feature in at least one of the first body and the second body, the first cap engagement feature being configured to engage with an exterior projection on the suppressor. In another embodiment, the suppressor tool further includes a second cap engagement feature in at least one of the first body and the second body, the second cap recess being configured to engage with the exterior projection on the suppressor. In another embodiment, the first and second engagement features are constructed from a different material than the first body and the second body. In another embodiment, the first body defines a first recess, the first engagement feature being positioned on a wall of the first recess, wherein the second body defines a second recess, the second engagement feature being positioned on a wall of the second recess. In another embodiment, the first and second recesses combine to form a cylindrical passage when the suppressor tool is in a closed position. In another embodiment, the first and second engagement features are spaced about 180 degrees from each other within the cylindrical passage when the suppressor tool is in the closed position. In another embodiment, the suppressor tool further includes a hinge, the first and second bodies being connected at the hinge.

In another aspect, the disclosed technology relates to a modular suppressor including: a barrel attachment portion having a central passage, the barrel attachment portion being configured to attach to a firearm barrel; a cap portion having a central passage; a body portion having an internal baffle structure and an expansion chamber, the body portion being attachable to and separable from each of the barrel attachment portion and the cap portion, wherein the body portion defines a central passage that is alignable with the central passage of the barrel attachment portion and the central passage of the cap portion; and wherein the barrel attachment portion, cap portion, and body portion include at least one tool receiving feature that is sized and shaped to mate with a suppressor tool. In one embodiment, the modular suppressor further includes a plurality of body portions attached to and separable from each other. In another embodiment, the overall length of the modular suppressor changes with the addition of body portions mounted between the barrel attachment portion and the cap portion.

In another aspect, the disclosed technology relates to a firearm that includes the modular suppressor.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
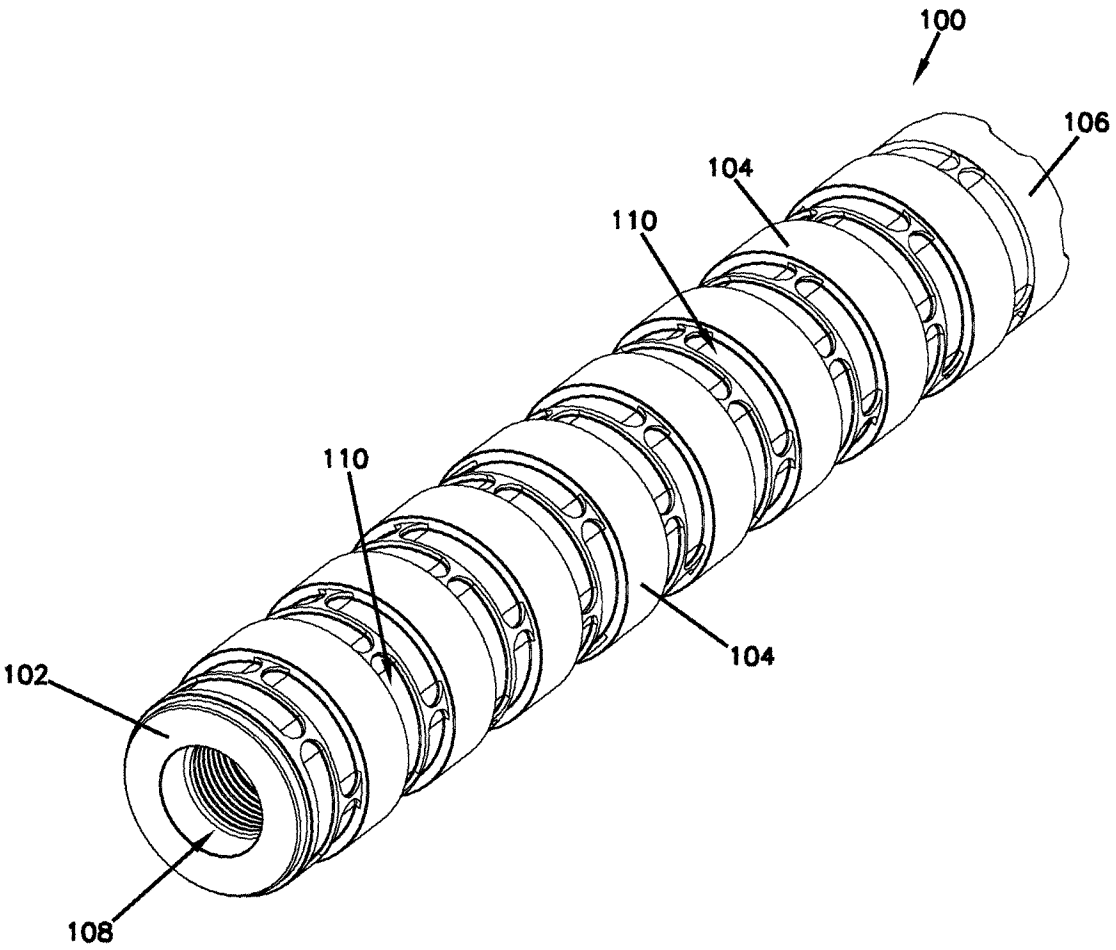
FIG. 1 illustrates a rear perspective view of a suppressor, according to one embodiment of the present disclosure.
Figure 2:
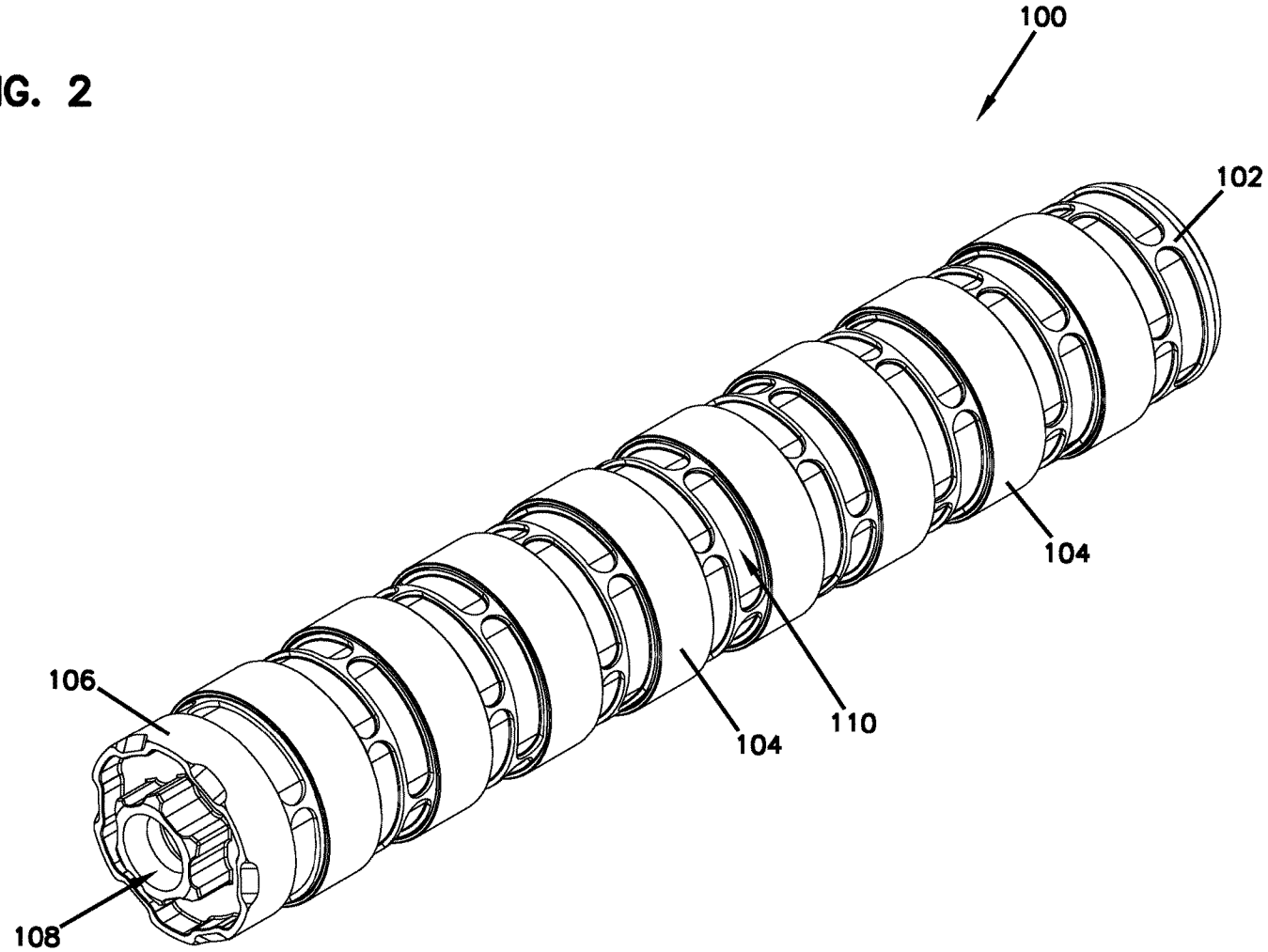
FIG. 2 illustrates a front perspective view of the suppressor of FIG. 1.
Figure 3:
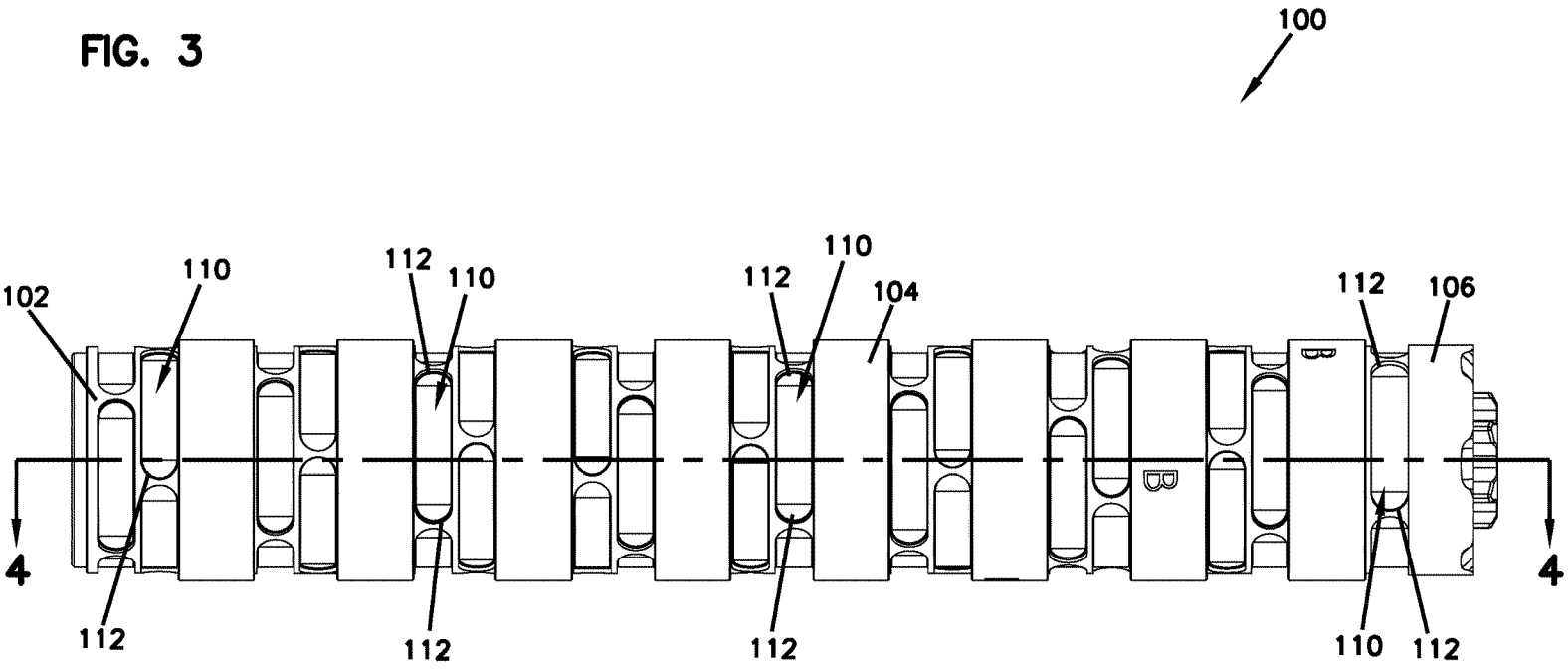
FIG. 3 illustrates a right side view of the suppressor of FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Firearm suppressors disclosed herein have one or more significant advantages. For instance, at least one example of the suppressor includes a plurality of modular portions that enable the user to modify the length of the suppressor and the number of baffles contained within the suppressor. This allows the user to customize the sound and flash reduction qualities of the suppressor to fit the user's particular needs. Further, at least one example of the suppressor disclosed herein can be configured to be assembled and disassembled using a suppressor tool that mates with modular portions of the suppressor. The suppressor tool allows the user to transfer the proper amount of torque to the modular portions so as to assemble and disassemble the suppressor without damaging the suppressor body. As a result, the suppressor can be manufactured with minimal wall thickness, providing a desirable end product with both reduced weight and maximized internal volume.

A suppressor 100 for a firearm is shown in FIGS. 1-5. The suppressor 100 is configured to reduce the noise and flash of a discharged round of ammunition. The suppressor 100 has a modular construction and a generally cylindrical shape. In the depicted example, the suppressor 100 includes a barrel attachment portion 102, a plurality of body portions 104, and a cap portion 106. The suppressor 100 defines a central passage 108 sized so that a projectile can travel from the barrel attachment portion 102, through the body portions 104, and exit from the cap portion 106. The suppressor 100 is configured to be attached to a firearm barrel at the barrel attachment portion 102. In some examples, the suppressor 100 is threaded on the barrel of the firearm. In some examples, the suppressor 100 is at least partially ornamental in nature and features nonfunctional elements.

The suppressor 100 can be used with a variety of firearms, including, but not limited to, pistols and rifles. For, the example the suppressor 100 can be used with pistols and rifles having a standard bore of .22 caliber. In some examples, the suppressor 100 can be used with rimfire ammunition. Other examples of calibers that can be used with the suppressor 100 include, but are not limited to, .22 LR, .17 HMR, .22 MAG, and 5.7×28 FN. In some examples, the suppressor 100 can be used with AR-15 and M-16 firearms having a standard bore of .223 caliber (5.56 mm). A firearm can include a barrel with a threaded extension for receiving the suppressor 100—e.g., the barrel attachment portion 102. Suppressor 100 can also be utilized with other firearms of other types and caliber.

The barrel attachment portion 102, body portions 104, and cap portion 106 are all separably attached to one another so as to allow the user to customize the size and performance of the suppressor 100. In some examples, the barrel attachment portion 102, body portions 104, and cap portion 106 are each threadably attached to one another. Specifically, the barrel attachment portion 102 may be attached to a single body portion 104, one or more additional body portions 104 (if desired) may be attached to each other in series, and a final body portion 104 may be attached to the cap portion 106. The user is therefore able to add or remove body portions 104 between the barrel attachment portion 102 and the cap portion 106 to alter the length and the performance of the suppressor.

In one example, the suppressor may include one barrel attachment portion, one body portion, and one cap portion. In other examples, the suppressor may include a barrel attachment portion, more than one body portion (e.g., 2, 3, 4, 5, 6, 7, 8, 9, 10, 11, 12 or more), and one cap portion. In the example shown in FIGS. 1-5, the suppressor 100 includes one barrel attachment portion 102, seven body portions 104, and one cap portion 106.

The barrel attachment portion 102, body portion(s) 104, and cap portion 106 may each include one or more recesses 110 disposed in the exterior surface of each portion. In at least one example, the recesses 110 can be configured to be identically sized on each portion 102, 104, and 106 and disposed around the circumference of each of portions is 102, 104, and 106. In this example, the recesses 110 provide a mating surface for a suppressor tool 148 (shown in FIGS. 16-22) to interface with so that a suppressor tool can transfer torque to each portion 102, 104, and 106 for assembly and disassembly of the suppressor 100. The operation and configuration of the suppressor tool 148 is further discussed herein with reference to FIGS. 16-22.

In at least one example, each recess 110 has a shape (e.g., arcuate) generally mirroring the shape of at least a portion of the exterior surface of each of the barrel attachment, body, and cap portions 102, 104, and 106. In some examples, each recess 100 includes a pair of rounded corners 112. In some examples, the recesses 110 are grouped together so that four recesses 110 are radially aligned around the exterior surfaces of the portions 102, 104, 106, thereby forming a ring of recesses 110 disposed around the circumferences of the portions 102, 104, and 106. In some examples, the barrel attachment portion 102 and the body portion 104 include two rings of recesses 110 disposed on each respective exterior surface. With respect to each of the barrel attachment, body, and cap portions, it is considered within the scope of the present disclosure that the recesses 110 can be a variety of different shapes for allowing torque to be transferred from the suppressor tool 148 to the suppressor 100; and one or more recesses (e.g., 1, 2, 3, 4, 5 or more) may be included.

Figure 4:
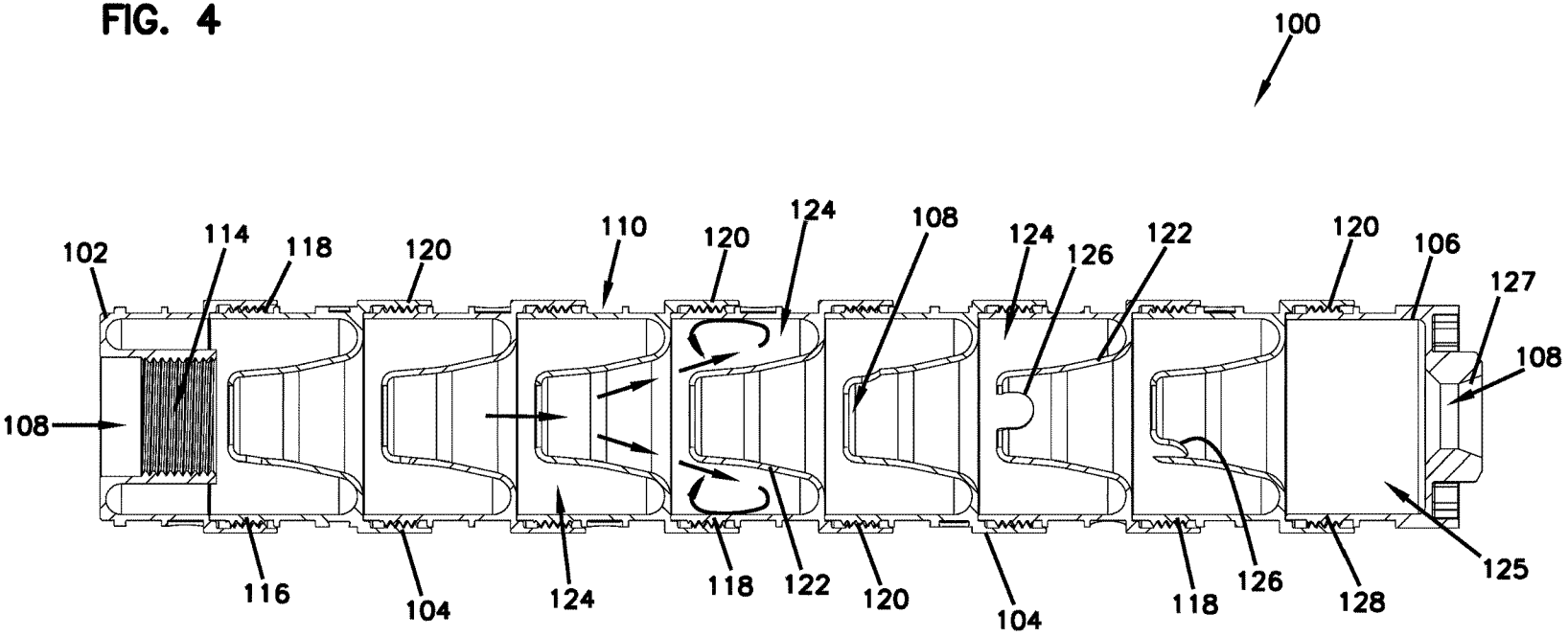
FIG. 4 illustrates a cross sectional view along line 4-4 (shown on FIG. 3) of the suppressor of FIG. 1.

FIG. 4 shows a longitudinal cross section of the suppressor 100 along line 4-4. The central passage 108 travels through the entire length of the suppressor 100 and is defined by the barrel attachment portion 102, the body portion(s) 104, and the cap portion 106.

The barrel attachment portion 102 includes a barrel attachment interface 114 that is configured to be attached to a firearm barrel. In some examples, the barrel attachment interface 114 is a threaded interface. In other examples, the barrel attachment interface 114 is a quick-connect interface. The barrel attachment portion 102 also includes a body attachment interface 116 that is configured to receive a body portion 104 for attachment thereto. In the depicted example, the body attachment interface 116 is a threaded interface, specifically a female threaded interface. In some examples, the body attachment interface 116 is a threaded male interface.

Each body portion 104 includes a first attachment interface 118 and a second attachment interface 120, both being configured to attach the individual body portions 104 to other body portions 104 or to the barrel attachment portion 102 or the cap portion 106. In some examples, the first attachment interface 118 is a male threaded interface. In some examples, the second attachment interface 120 is a threaded female interface. In at least one example, each body portion 104 is attachable, in any order, to other body portions 104, and to barrel attachment portion 102 and cap portion 106.

Each body portion 104 also includes at least one internal baffle 122 and at least one expansion chamber 124. Each baffle 122 and expansion chamber 124 enhances the reduction of sound and flash of the firearm. The baffles 122 and expansion chambers 124 work together to lower the speed and pressure at which propellant gases exit the suppressor 100.

In at least one example, at least one baffle 122 has a conical shape that surrounds the central passage 108. In another example, at least one baffle 122 has a frusto-conical shape that surrounds the central passage 108. The baffles are sized and shaped to divert propellant gases from the central passage 108 as the propellant gases travel generally from the barrel attachment portion 102 to the cap portion 106. Specifically, the baffles divert propellant gases into the expansion chambers. For example, as shown in FIG. 4, the baffle 122 extends outwardly from the central passage 108 as the gases flow from the barrel attachment portion 102 to the cap portion 106. This outward extension directs gases away from the central passage 108 and into the expansion chamber 124 of the adjoining body portion 104 (an example flow is illustrated in FIG. 4 by arrows). As the gases enter the expansion chamber 124, the gases swirl within the chamber creating turbulence. Such turbulence lowers the velocity of the propellant gases, which thereby lowers the pressure at which the propellant gases eventually escape the cap portion 106. The baffles 122 and expansion chambers 124 of the body portions 104 also extend the time it takes for the propellant gases to exit the suppressor 100.

In some examples, a cross-flow aperture 126 is positioned on each baffle 122, allowing propellant gases to flow into the expansion chamber(s) 124 in a generally perpendicular direction from the central passage 108. In some examples, the cross-flow apertures 126 of each body portion 104 are positioned in different circumferential positions with respect to the suppressor 100. For example, the first two body portions 104 immediately adjacent the barrel attachment portion 102 may include cross-flow apertures 126 that are generally positioned at the same o'clock position (when viewed along the central passage 108 from the barrel attachment portion 102 of the suppressor 100). In such an example, successive body portions 104 (viewed in the direction toward the cap portion 106) include cross-flow apertures 126 that are positioned on the baffles 122 in a position that is at least partially rotated with respect to the positions of the preceding cross-flow apertures 126. Alternative positioning of the cross-flow apertures 126 can be achieved as well, and may be customized by the user depending on the desired length of the suppressor 100 and the manner in which it is to be used.

The cap portion 106 includes a body attachment interface 128 that is configured to be secured to the second attachment interface 120 of the body portion 104. In some examples, the body attachment interface 128 is a threaded male interface. The cap portion 106 also includes an expansion chamber 125 that is sized and shaped to allow gases traveling along the central passage 108 to expand a final time before exiting an exit aperture 127 disposed in the cap portion 106. The exit aperture 127 is sized and shaped to allow a projectile to exit therefrom.

Figure 5:
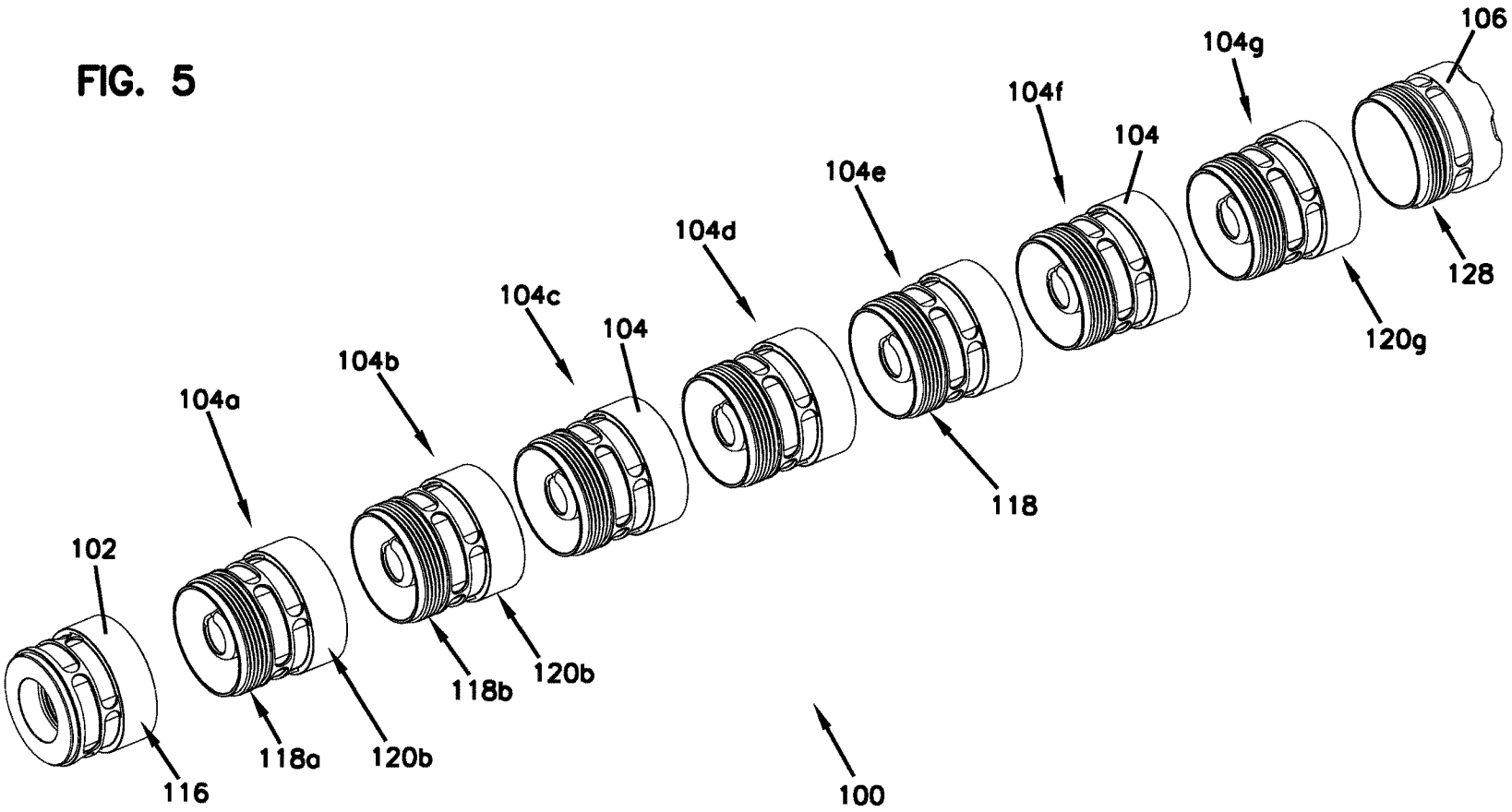
FIG. 5 illustrates an exploded view of the suppressor of FIG. 1.

FIG. 5 shows an exploded view of an example of the suppressor 100. To assemble the suppressor 100, the body attachment interface 116 of barrel attachment portion 102 is mated with the first attachment interface 118*a* of a first body portion 104*a*. The second attachment interface 120*a* of the first body portion 104*a* is then mated with the first attachment interface 118*b* of a second body portion 104*b*. This process continues until the body portions 104*a*, 104*b*, 104*c*, 104*d*, 104*e*, 104*f*, 104*g* are assembled with one another. The second attachment interface 120*g* of the final body portion 104*g* is then mated with the body attachment interface 128 of the cap portion 106 to complete the assembly of the suppressor 100. As noted above, the suppressor 100 may include more or fewer body portions 104. Also, the suppressor 100 may be assembled by attaching the above-mentioned components in any order.

Figure 6:
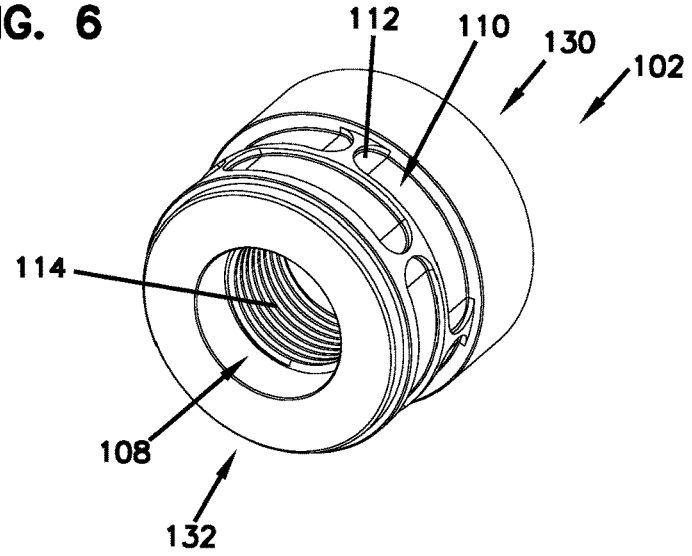
FIG. 6 illustrates a rear perspective view of a barrel attachment portion, according to one embodiment of the present disclosure.
Figure 7:
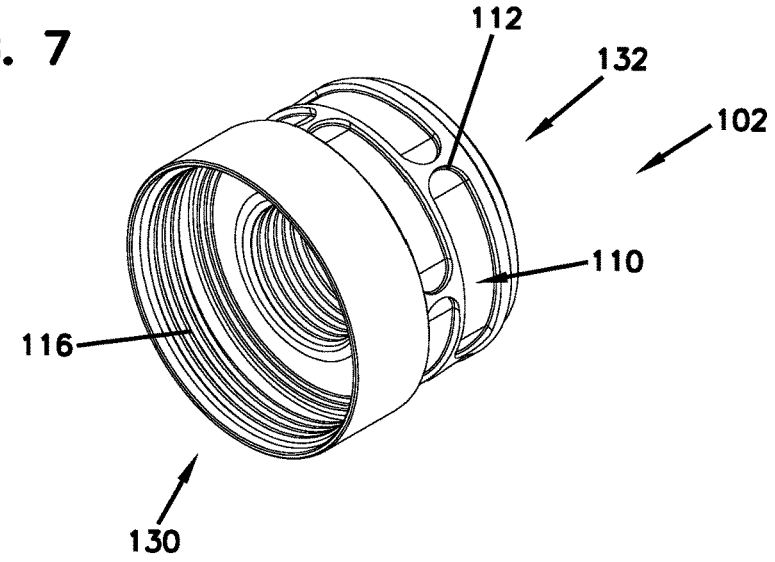
FIG. 7 illustrates a front perspective view of the barrel attachment portion of FIG. 6.
Figure 8:
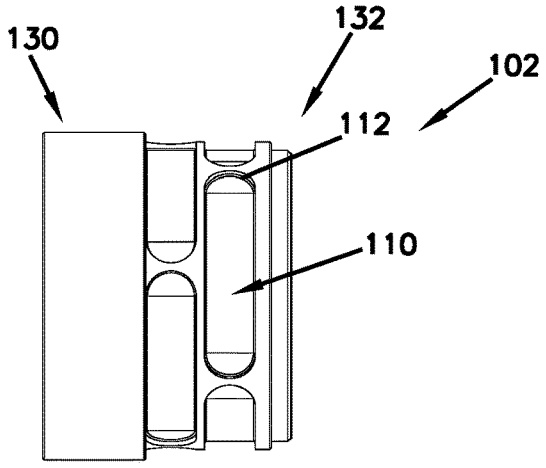
FIG. 8 illustrates a left side view of the barrel attachment portion of FIG. 6.

FIGS. 6-8 show an example of the barrel attachment portion 102 having a front 130 and a rear 132. At the rear 132, the barrel attachment interface 114 is positioned around the central passage 108. The central passage 108 is configured to receive a barrel of a firearm and the barrel attachment interface 114 is sized and shaped to secure the barrel attachment portion 102 to the barrel of the firearm. The exterior of the barrel attachment portion 102 (like the exteriors of the body portion 104 and the cap portion 106) may comprise one or more recesses 110 (having an arcuate or other shape) disposed thereon. In one example, the barrel attachment portion 102 includes two rings of recesses 110 surrounding the circumference of the exterior of the barrel attachment portion 102. In other examples, the barrel attachment portion 102 can contain more or fewer (e.g., 0 or 1) recesses 110, and more or fewer (e.g., 0 or 1) rings of recesses. In some examples, the barrel attachment portion 102 is at least partially ornamental in nature and features nonfunctional elements.

Figure 9:
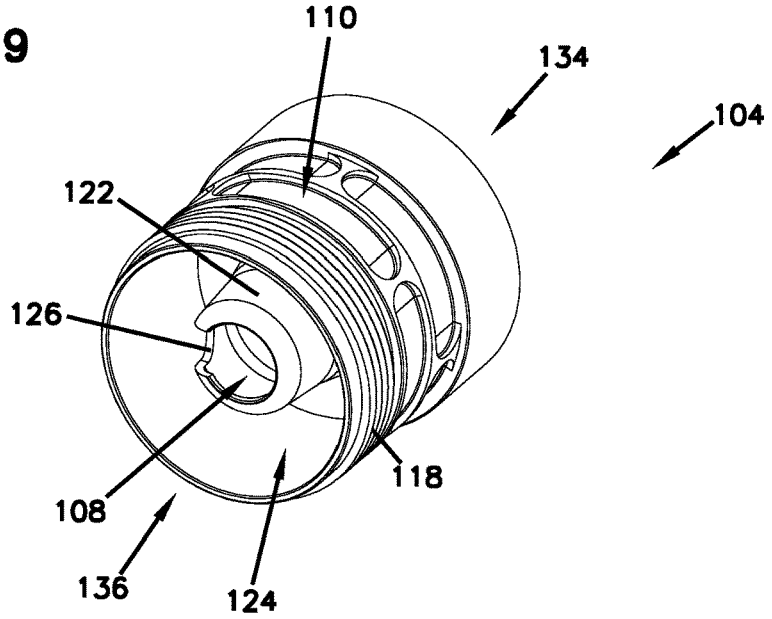
FIG. 9 illustrates a rear perspective view of a body portion, according to one embodiment of the present disclosure.
Figure 10:
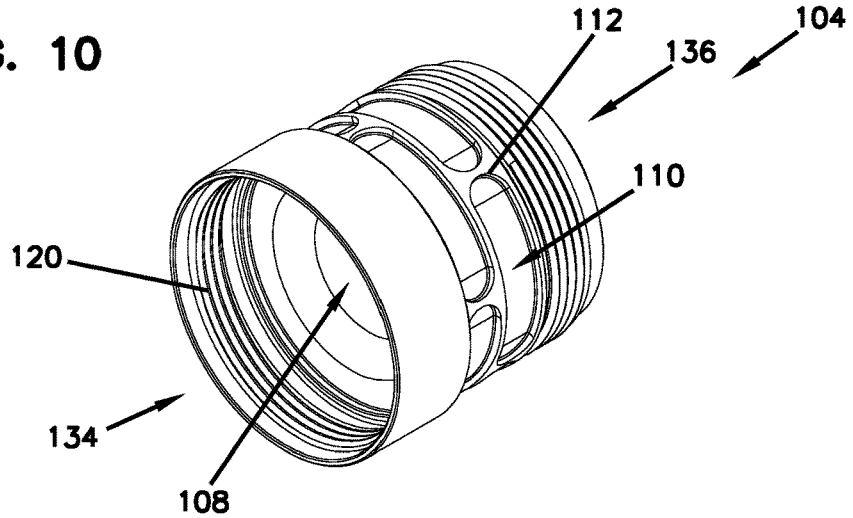
FIG. 10 illustrates a front perspective view of the body portion of FIG. 9.
Figure 11:
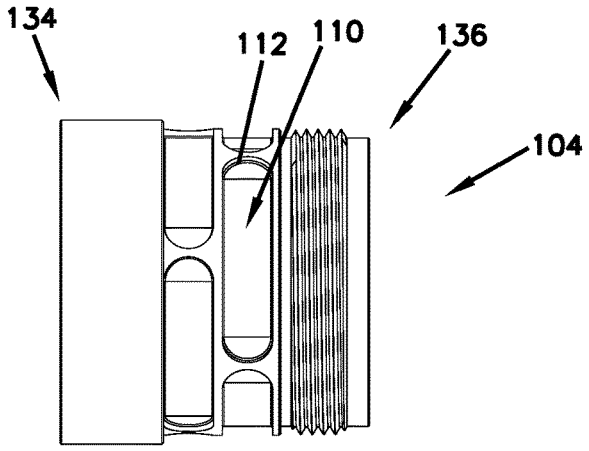
FIG. 11 illustrates a left side view of the body portion of FIG. 9.
Figure 12:
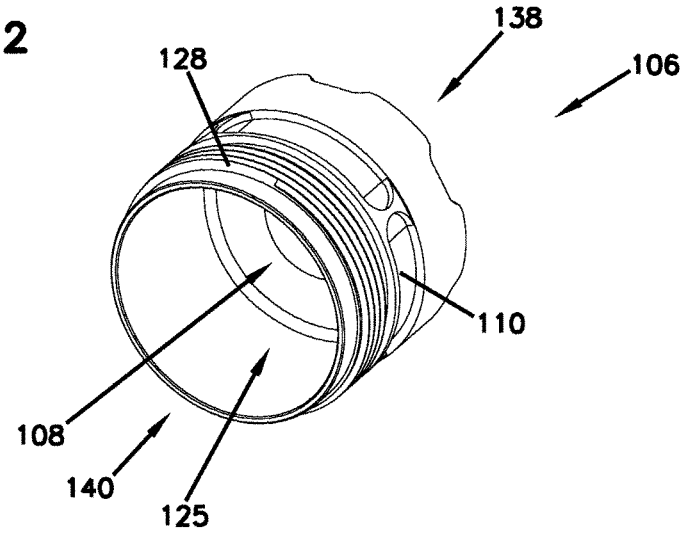
FIG. 12 illustrates a rear perspective view of a cap portion, according to one embodiment of the present disclosure.
Figure 13:
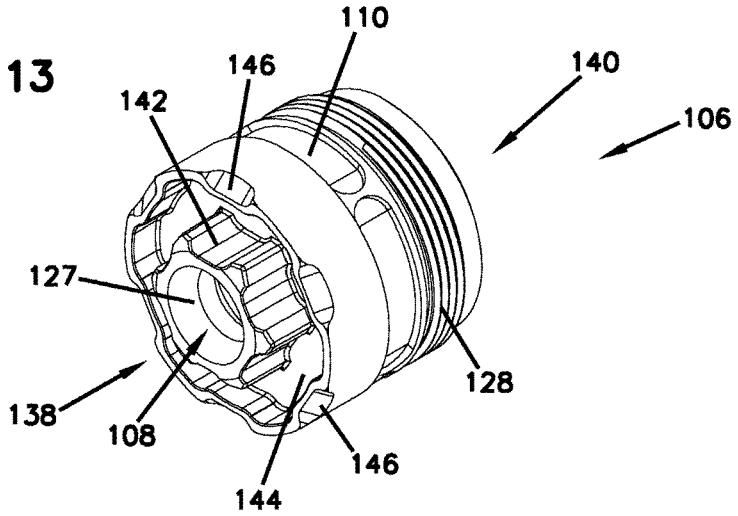
FIG. 13 illustrates a front perspective view of the cap portion of FIG. 12.
Figure 14:
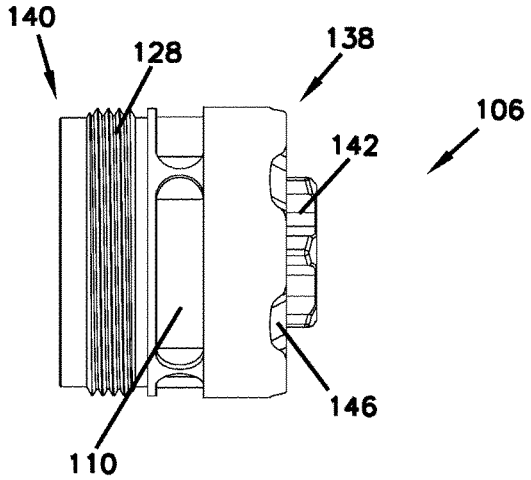
FIG. 14 illustrates a right left side view of the cap portion of FIG. 12.

FIGS. 9-11 show an example of the body portion 104 having a front 134 and a rear 136. At the rear 136, the first attachment interface 118 is disposed on the exterior of the body portion 104. During operation, gases travel from the rear 136 toward the front 134. As shown in FIG. 9, when gases are received at the rear 136 of the body portion 104 along the central passage 108, they encounter the baffle 122 and the expansion chamber 124 that surrounds the baffle 122. Gases can thus travel from the central passage 108 to the expansion chamber 124 via the cross-flow aperture 126 disposed in the baffle 122. At the front 134, the second attachment interface 120 is disposed inside the body portion 104. The exterior of the body portion 104 (like the exteriors of the barrel attachment portion 102 and the cap portion 106) may comprise one or more recesses 110 (having an arcuate or other shape) disposed thereon. In one example, the body portion 104 includes two rings of recesses 110 surrounding the circumference of the exterior of the body portion 104. In other examples, the body portion 104 can contain more or fewer (e.g., 0 or 1) recesses 110, and more or fewer (e.g., 0 or 1) rings of recesses. In some examples, the body portion 104 is at least partially ornamental in nature and features nonfunctional elements.

FIGS. 12-15 show an example of the cap portion 106 having a front 138 and a rear 140. At the rear 140, the body attachment interface 128 is disposed on the exterior of the cap portion 106. During operation, the cap portion 106 receives gases traveling from the body portions 104 at the rear 140. The gases then travel toward the front 138, within the expansion chamber 125, and exit the cap portion 106 at the exit aperture 127 disposed at the front 138. The exit aperture 127 is aligned with the central passage 108. In this example, the cap portion 106 also includes an exterior cap projection 142 surrounding the central passage 108, but more than one exterior projection or no exterior projections may be included; and the exterior cap projection 142 is surrounded by a front recess 144, but more than one front recess or no front recess may be included. Also in this example, a plurality of indentations 146 is disposed in the exterior surface at the front 138 of the cap portion 106.

The exterior of the cap portion 106 (like the exteriors of the barrel attachment portion 102 and the body portion 104) may comprise one or more recesses 110 (having an arcuate or other shape) disposed thereon. The cap portion 106 includes a single ring of recesses 110 surrounding the circumference of the exterior of the cap portion 106. In other examples, the cap portion 106 can contain more or fewer (e.g., 0 or 1) recesses 110, and more or fewer (e.g., 0 or 1) rings of recesses. In some examples, the cap portion 106 is at least partially ornamental in nature and features nonfunctional elements.

Figure 15:
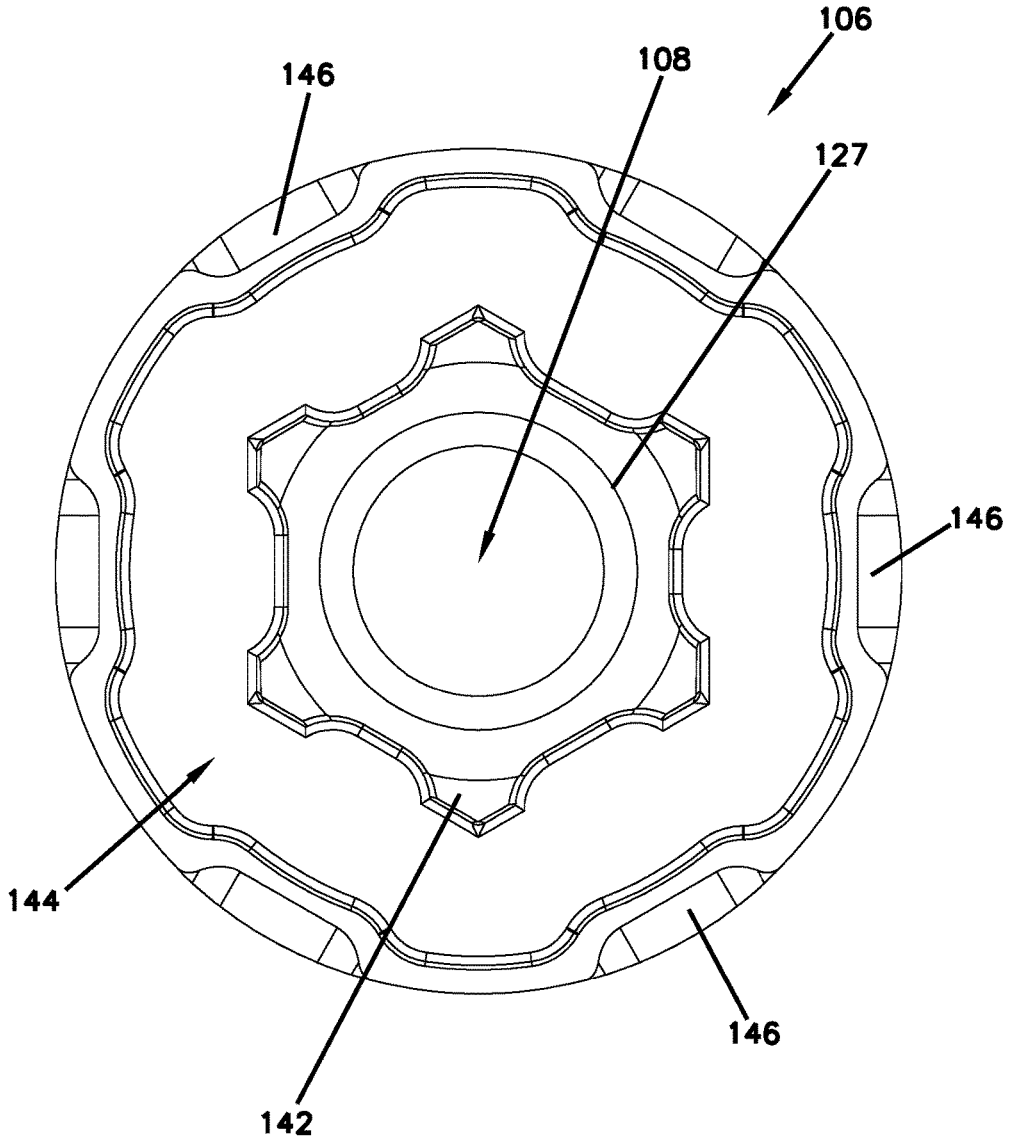
FIG. 15 illustrates a front view of the cap portion of FIG. 12.

FIG. 15 shows an example of the front 138 of the cap portion 106 where the exterior cap projection 142, front recess 144, and indentations 146 are sized and configured to aid in rotating the cap portion 106 for assembly and disassembly of the suppressor 100. In some examples, the cap portion 106 can be used with other types of suppressors such as tube suppressors having a fixed length.

In the example shown in FIG. 15, the exterior cap projection 142 has six sides. In other examples, the exterior projection can have more or fewer sides. The exterior cap projection 142 protrudes from the cap portion 106 so as to allow a suppressor tool to engage the exterior cap projection 142 for rotating the cap portion 106. In some examples, the front recess 144 provides additional surfaces for a suppressor tool to engage the cap portion 106 so as to distribute rotational forces about the cap portion 106. In some examples, the exterior cap projection 142 is sized and shaped to receive a 0.5 inch socket.

In one example, the barrel attachment portion 102, the body portion 104, and/or the cap portion 106 may be manufactured from metal—e.g., 6061 aluminum, 7075 aluminum, 17-4 ph stainless steel, etc.

Figure 16:
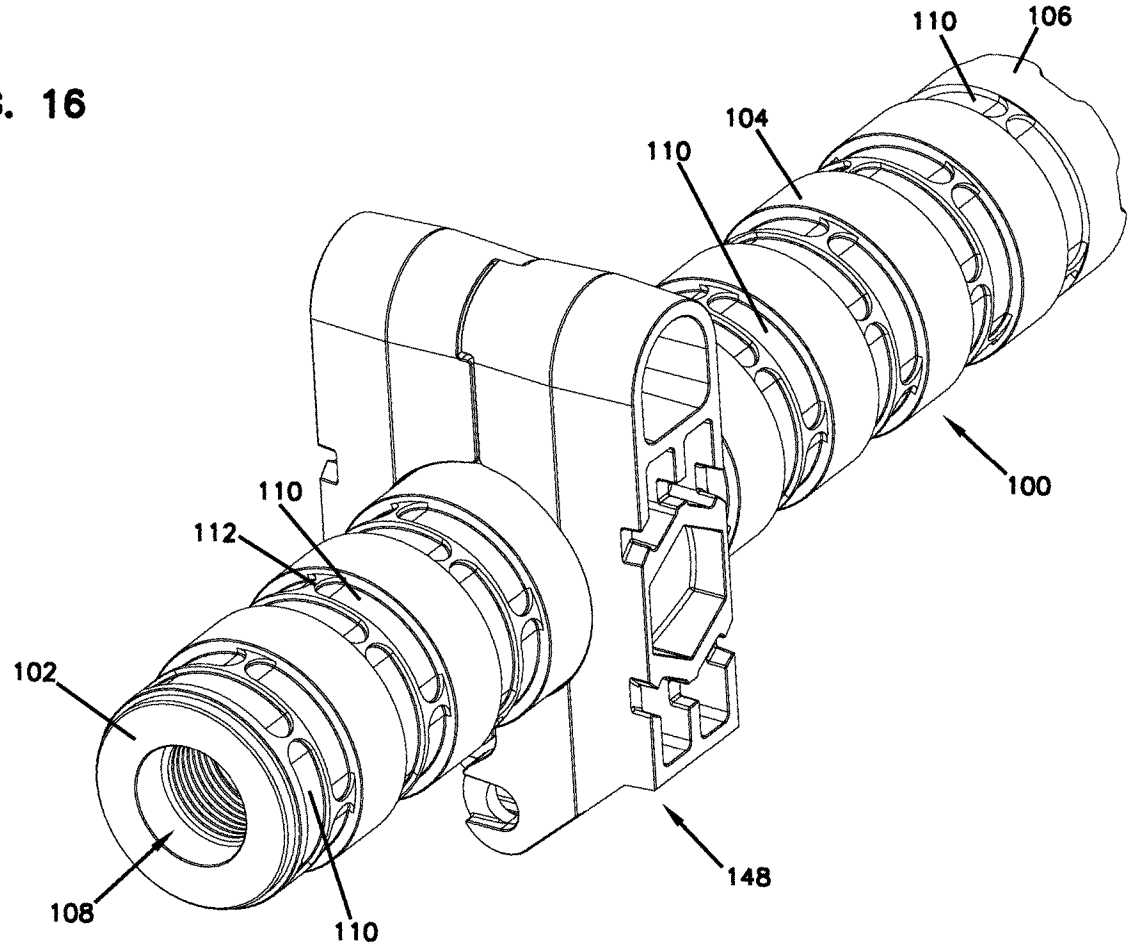
FIG. 16 illustrates a rear perspective view of a suppressor and a suppressor tool, according to one embodiment of the present disclosure.

FIG. 16 shows a perspective view of an example of the suppressor tool 148 positioned around the suppressor 100. The suppressor tool 148 is sized and shaped to be removably positioned around the portions 102, 104, and 106 so as to allow a user to rotate each portion 102, 104, and 106 for assembly and disassembly of the suppressor 100. In the depicted example, the suppressor tool 148 is positioned around a body portion 104, and is configured to mate with the recesses 110 in the barrel attachment portion 102, body portion 104, and cap portion 106.

Figure 17:
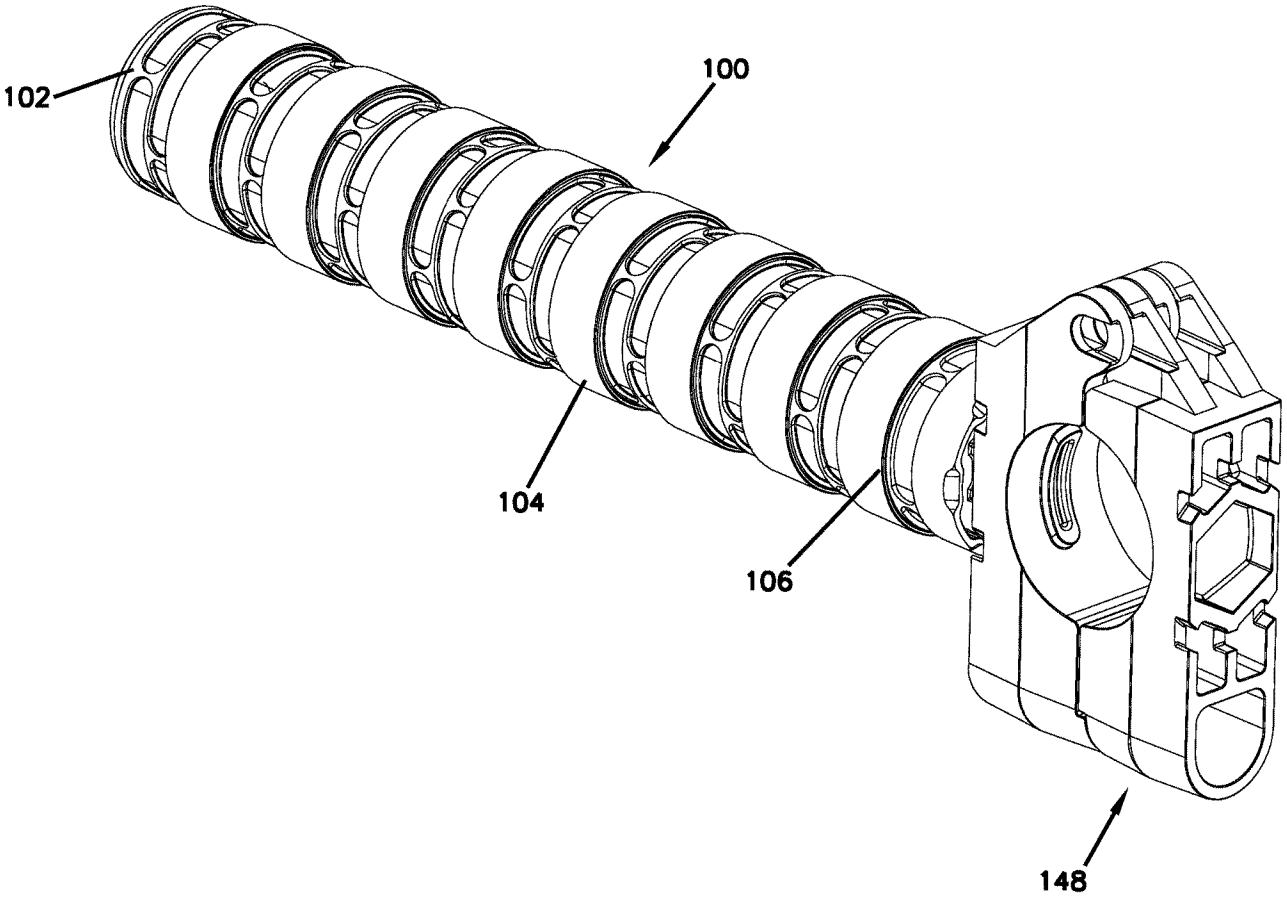
FIG. 17 illustrates a front perspective view of a suppressor and a suppressor tool, according to one embodiment of the present disclosure.

FIG. 17 shows an example of the suppressor tool 148 mated with the cap portion 106. Specifically, the suppressor tool 148 is sized and shaped to engage the exterior cap projection 142. In some examples, the suppressor tool 148 is sized and shaped to be at least partially positioned inside the front recess 144 of the cap portion 106.

Figure 18:
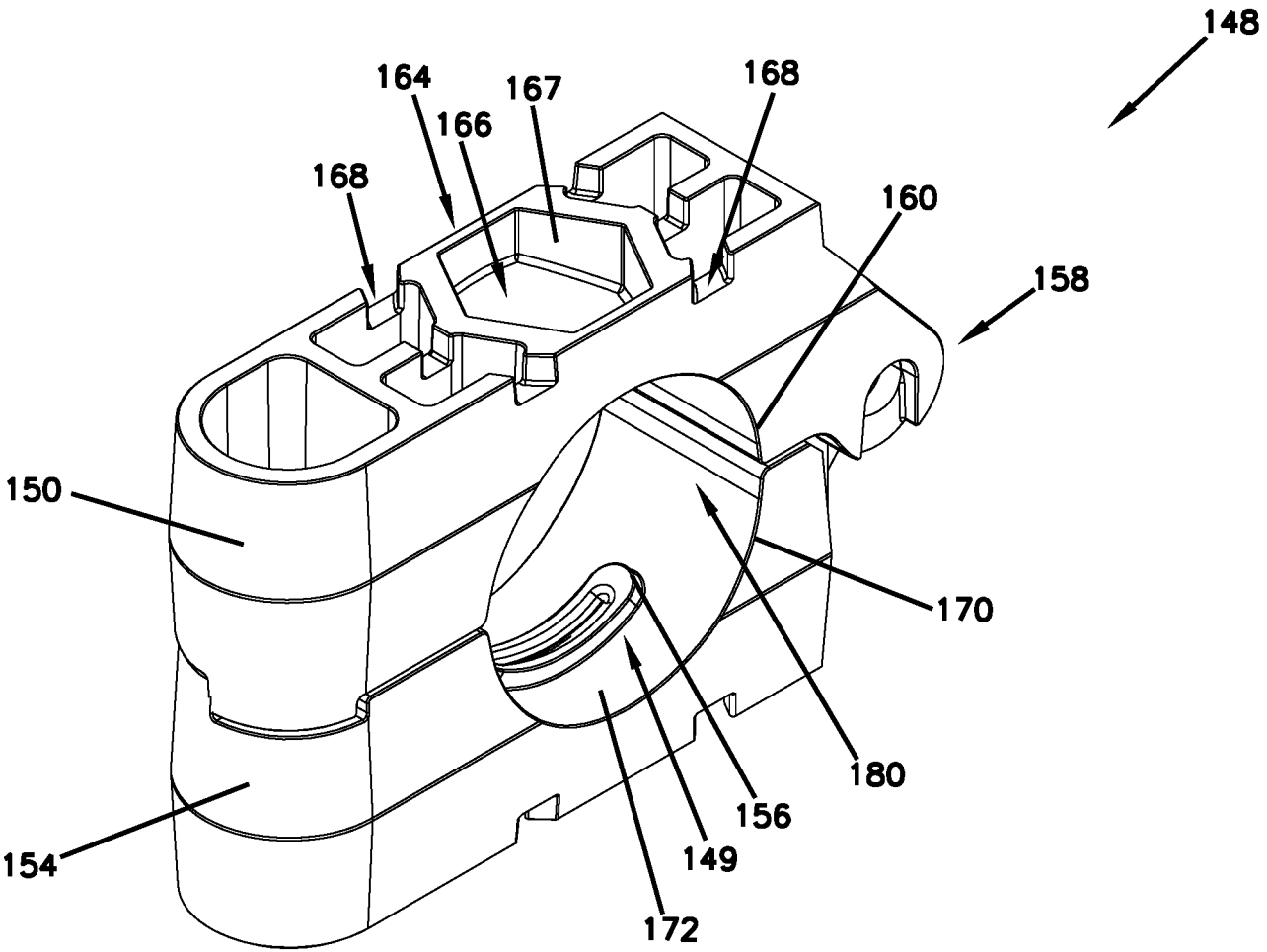
FIG. 18 illustrates a perspective view of a suppressor tool in the closed position, according to one embodiment of the present disclosure.
Figure 19:
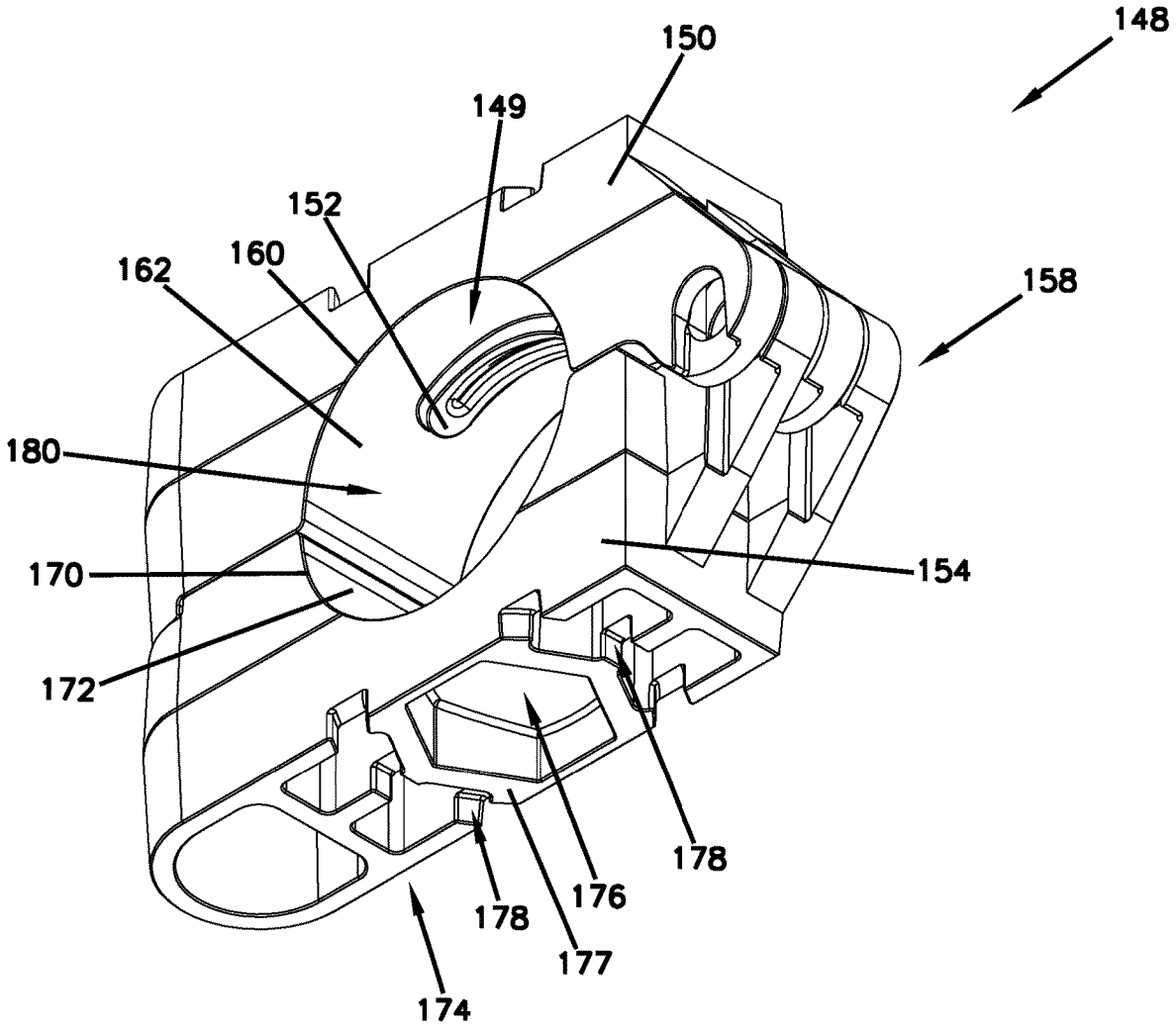
FIG. 19 illustrates another perspective view of the suppressor tool of FIG. 18 in the closed position.
Figure 20:
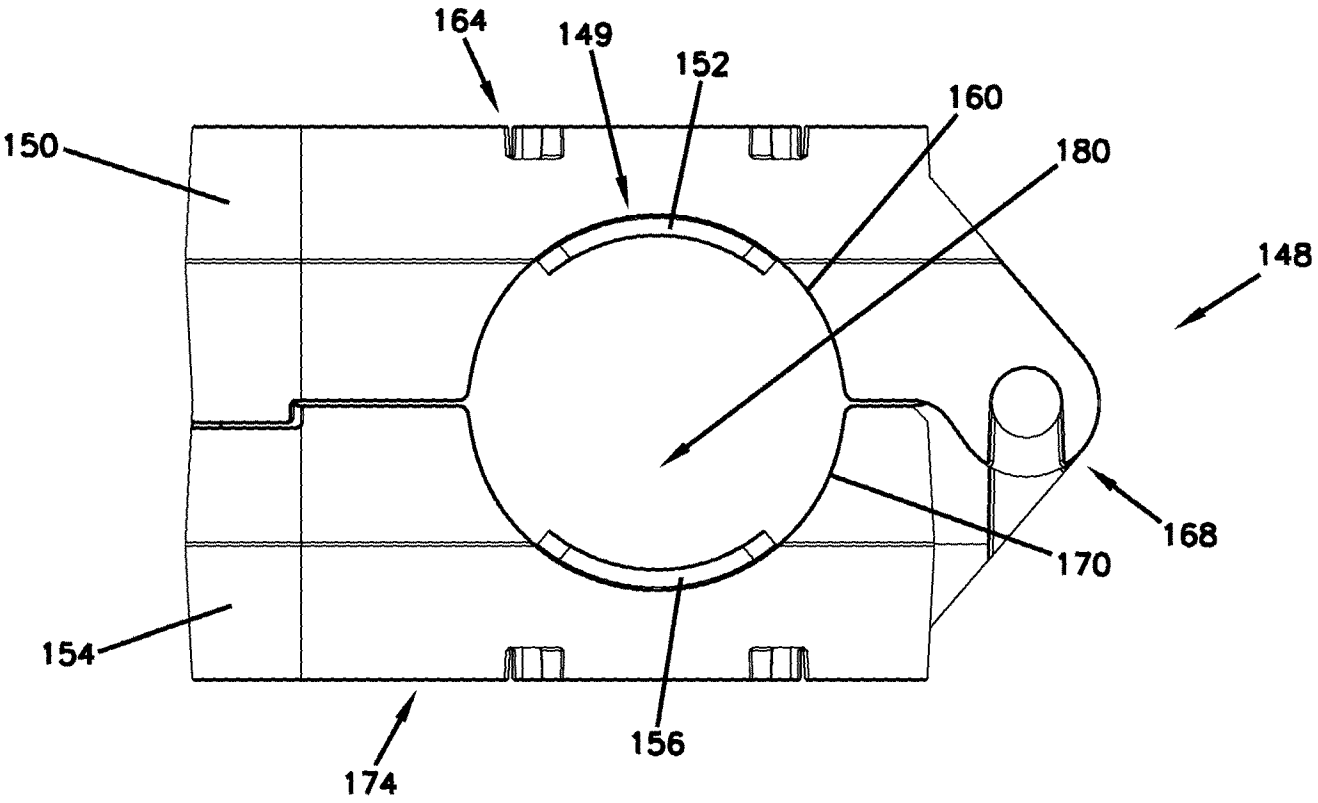
FIG. 20 illustrates a side view of the suppressor tool of FIG. 18 in the closed position.
Figure 21:
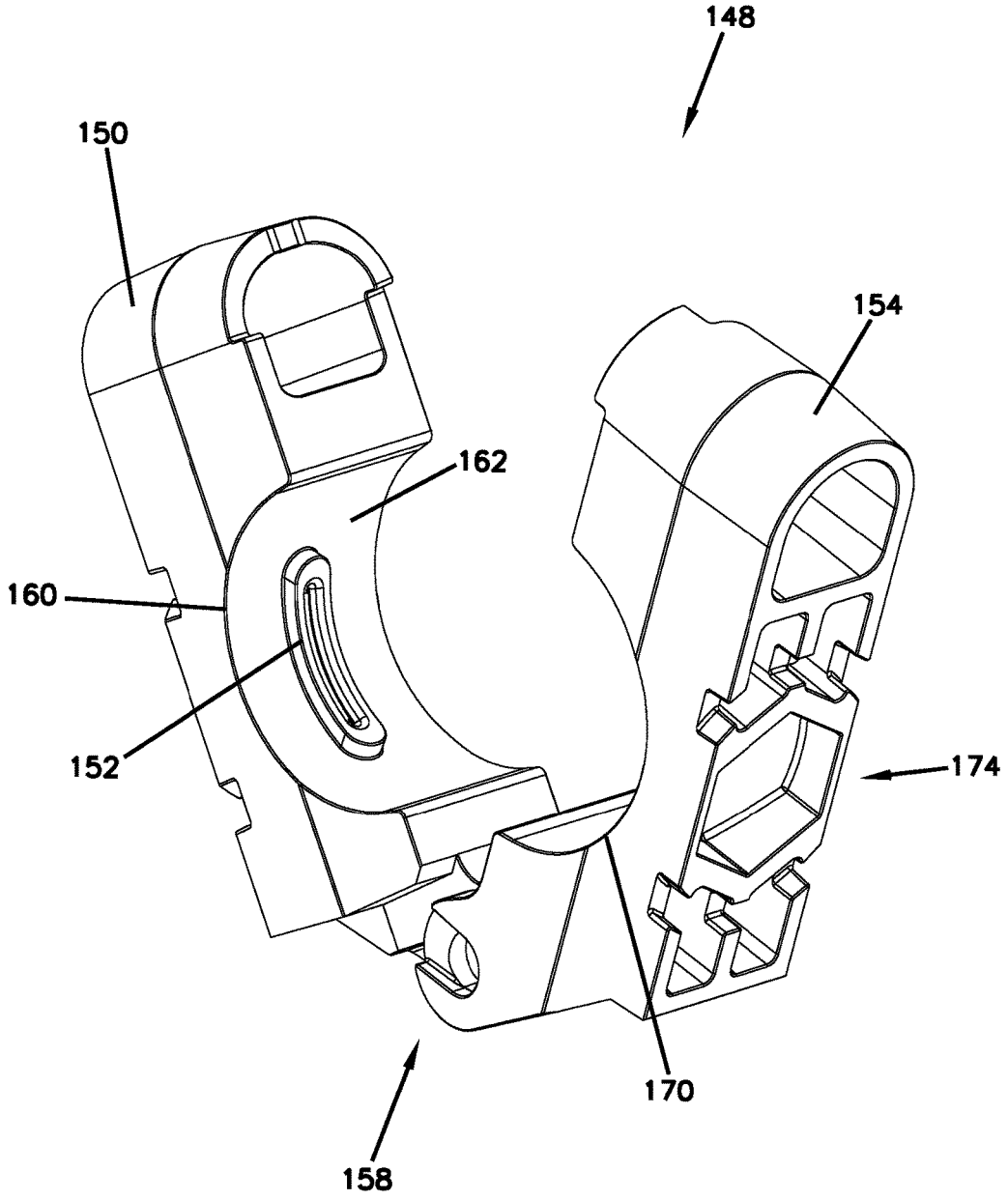
FIG. 21 illustrates another perspective view of the suppressor tool of FIG. 18 in the open position.
Figure 22:
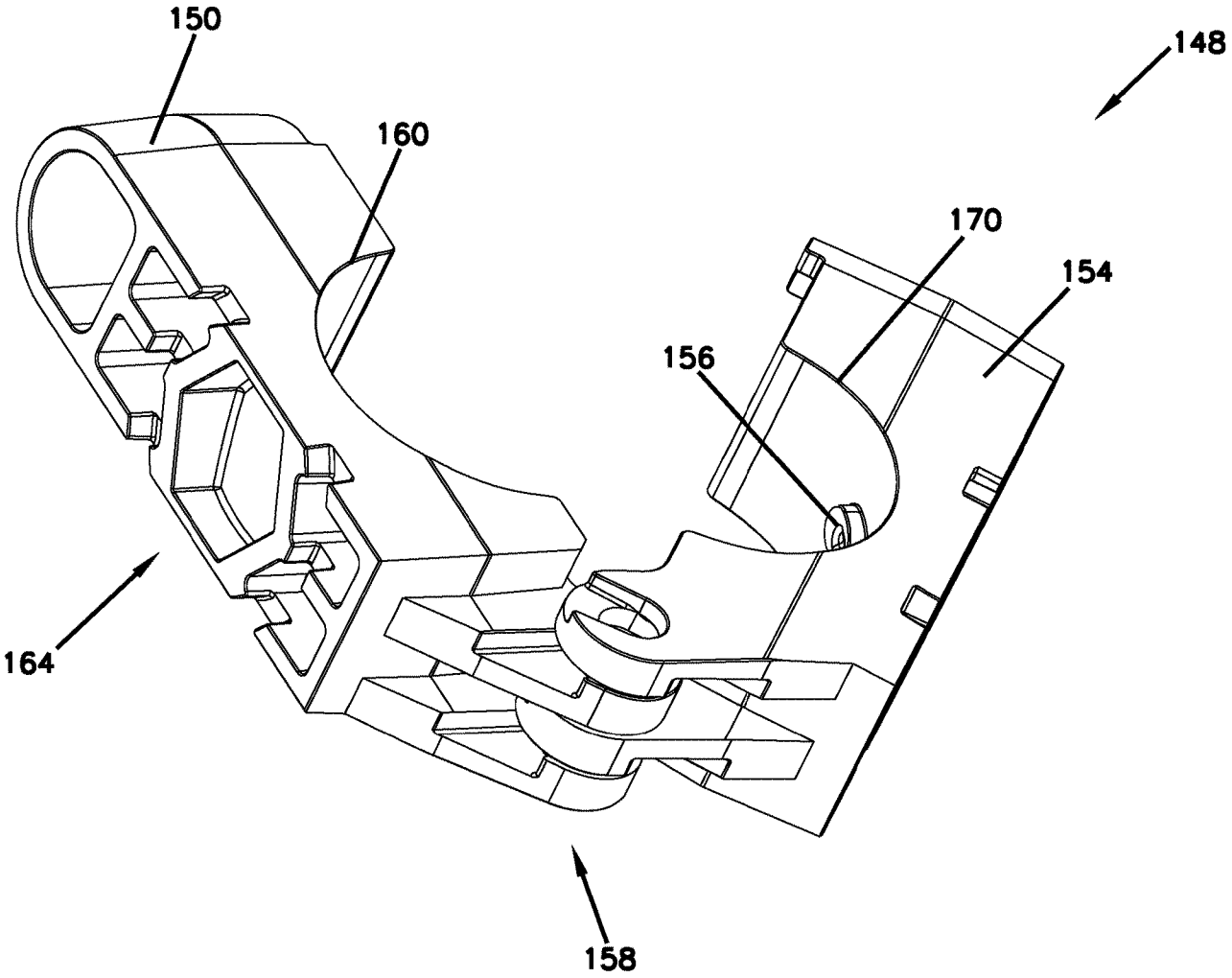
FIG. 22 illustrates another perspective view of the suppressor tool of FIG. 18 in the open position.

FIGS. 18-22 show an example of the suppressor tool 148. In FIGS. 18-20, the suppressor tool 148 is in a closed position. In FIGS. 21-22, the suppressor tool 148 is in an open position.

In one example, the suppressor tool 148 may include a first body 150 and a second body 154. In some examples, at least one of the bodies 150, 152, includes an engagement feature 149 for engaging the suppressor tool 148 with portions of the suppressor 100. For example, the engagement 149 can be a first projection 152 on the first body 150 and a second projection 156 on the second body 154.

The second body 154 is mated with, and separable from, the first body 150. In the example shown in FIGS. 18-22, the first and second bodies 150 and 154 are identical to each other. In some examples, the first and second bodies 150 and 154 can be attached to each other at a hinge 158. In some examples, the suppressor tool 148 is at least partially ornamental in nature and features nonfunctional elements.

In one example, the first body 150 defines a first arced recess 160. The first projection 152 protrudes from a wall 162 of the first arced recess 160. In some examples, the first projection 152 has an arcuate shape. In some examples, the first projection 152 has an arcuate shape that is substantially similar to the arcuate shape of the recesses 110 disposed on the portions 102, 104 and 106 of the suppressor 100 so that the projection can effectively engage the recesses.

In one example, the first body 150 also defines a first cap engagement feature 164 disposed in the first body 150, opposite the first arced recess 160. The first cap engagement feature 164 may be sized and shaped to engage with the cap portion 106, specifically the exterior cap projection 142 and the front recess 144. The first cap engagement feature 164 can include a main recess 166 having six sides 167 that are sized and shaped to mate with the exterior cap projection 142 of the cap portion 106. In some examples, the main recess 166 includes more or fewer than six sides 167. In some examples, the main recess 166 has a hexagonal shape. In other examples, the main recess 166 includes more or fewer than six sides 167. The sides 167 can be configured to be positioned around the exterior cap projection 142 and inside the front recess 144 of the cap portion 106 when the suppressor tool 148 is engaged with the suppressor 100. The first cap engagement feature 164 may also include a pair of channels 168 that are configured to receive the walls of the front recess 144 of the cap portion 106. More or fewer channels 168 may be alternatively included. The indentations 146 of the cap portion 106 aid in keeping the channels 168 properly positioned on the cap portion 106 when the suppressor tool 148 is engaged with the cap portion 106.

In one example, the second body 154 defines a second arced recess 170. The second recess 170, like the first recess 160, has a wall 172 on which the second projection 156 may be disposed. In some examples, the second projection 156 is substantially similar to the first projection 152. The second body 154 also defines a second cap engagement feature 174 that is substantially similar to the first cap engagement feature 164. Like the first cap engagement feature 164, the second cap engagement feature 174 includes a main recess 176 having six sides 177 and a pair of channels 178. In some examples, the main recess 176 has a hexagonal shape. In other examples, the main recess can have more or fewer sides and more or fewer channels.

When the suppressor tool 148 is in the closed position, the first and second recesses 160,170 form a generally cylindrical passage 180. When in the closed position, the first and second projections 152 and 156 are spaced approximately 180 degrees from one another inside the cylindrical passage 180. In some examples, the suppressor tool 148 can include more or fewer projections (e.g., a single projection). In some examples, the projections 152 and 156 can be spaced less than 180 degrees from one another (e.g., 90-135 degrees).

FIGS. 21-22 show an example of the suppressor tool 148 in the open position, wherein the first and second bodies 150 and 154 are separated from one another to allow the suppressor tool 148 to be positioned around the suppressor 100. In some examples, the first and second bodies 150 and 154 can pivot away from each other about the hinge 158. In other examples, the first and second bodies 150 and 154 can be completely separate from one another.

To use the suppressor tool 148 in a first manner, the user initially manipulates the first and second bodies 150 and 154 to separate them from each other so that the suppressor tool 148 is in the open position. The suppressor tool 148 is then mated with a portion 102, 104, or 106 of the suppressor 100. This is done by moving the suppressor tool 148 around a portion 102, 104, or 106 so that the first and second bodies 150 and 154 are positioned on either side of the selected portion 102, 104, or 106. The user then moves the first and second bodies 150 and 154 so that the suppressor tool 148 is in a closed position. When in the closed position, the portion 102, 104, or 106 is positioned within the cylindrical passage 180, and the first and second projections 152 and 156 are within a pair of recesses 110 on the selected portion 102, 104, or 106. The user can then rotate the suppressor tool 148 (for assembly or disassembly) to cause the rotation of the portion 102, 104 or 106 as the mating of the projections 152 and 156 with recesses 110 allow torque to be transferred from the suppressor tool 148 to the portion 102, 104, or 106. This process can be repeated with multiple portions 102, 104, and 106 until assembly or disassembly of the suppressor 100 is completed to the extent desired by the user.

To use the suppressor tool 148 in a second manner, the user can employ only one of the first or second bodies 150 and 154. In some examples, the user can also use the closed suppressor tool 148. The user positions the first or second cap engagement feature 164 or 174 so that the main recess 166 or 176 receives the exterior cap projection 142 of the cap portion 106 of the suppressor 100. Once received by the main recess 166 or 176, the cap portion 106 can be rotated by the first body 150, second body 154, or closed suppressor tool 148.

Figure 23:
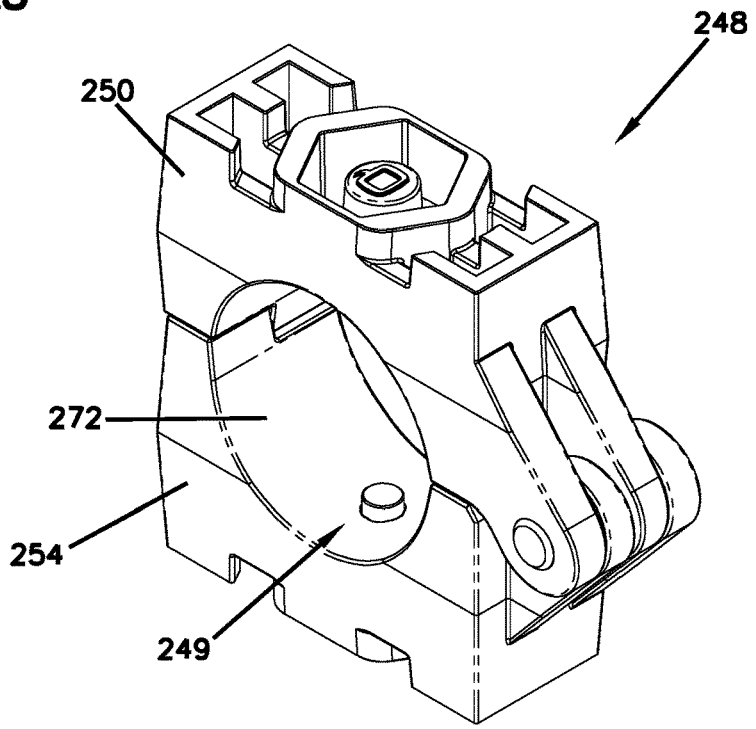
FIG. 23 illustrates a perspective view of a suppressor tool in a closed position, according to one embodiment of the present disclosure.
Figure 24:
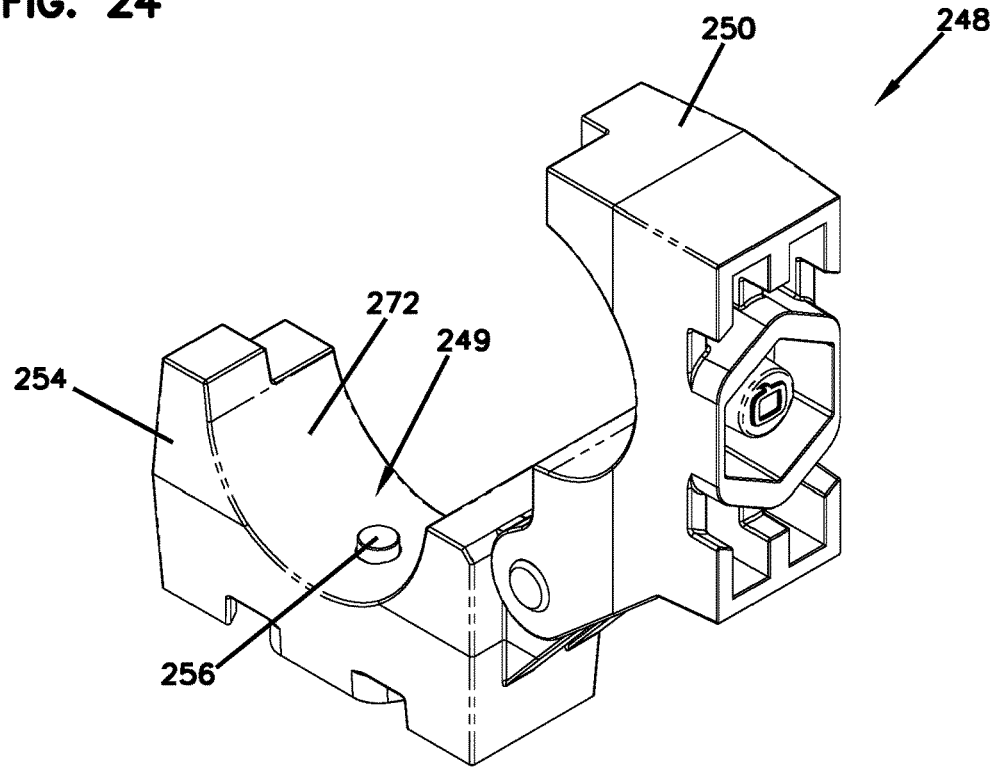
FIG. 24 illustrates another perspective view of the suppressor tool of FIG. 23 in an open position.
Figure 25:
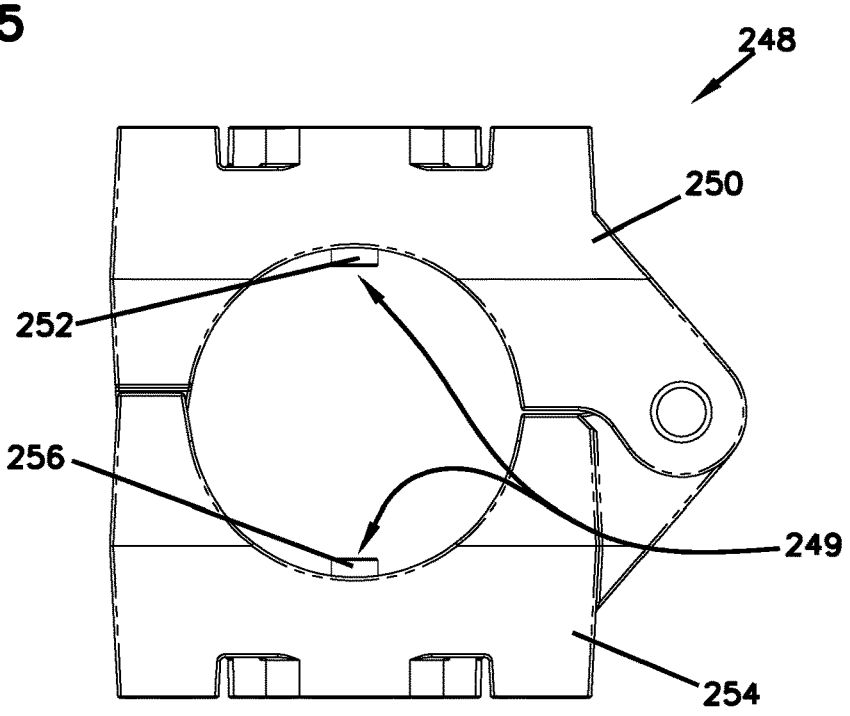
FIG. 25 illustrates a side view of the suppressor tool of FIG. 23 in the closed position.
Figure 26:
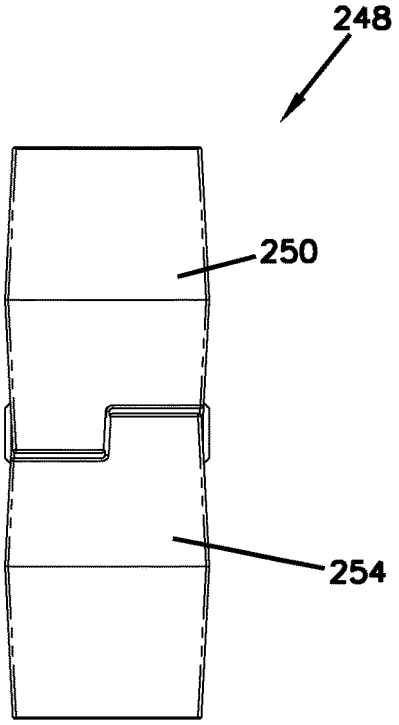
FIG. 26 illustrates an end view of the suppressor tool of FIG. 23 in the closed position.

FIGS. 23-25 show another example of a suppressor tool 248. FIG. 23 shows the suppressor tool 248 in the closed position. FIG. 24 shows the suppressor tool 248 in the open position. FIG. 25 shows a side view of the suppressor tool 248, and FIG. 26 shows an end view.

The suppressor tool 248 is substantially similar to the suppressor tool 148 described above. The suppressor tool 248 includes a first body 250 and a second body 254, and at least one of the first and second bodies 250, 254 includes an engagement feature 249 for engaging with portions of the suppressor 100. In some examples, the engagement features 249, like the engagement features 149 described above, are configured to be received by the recesses 110 the barrel attachment portion 102, body portion(s) 104, and cap portion 106.

In the depicted example, the engagement features 249 of the suppressor tool 248 are circular projections 252 and 256. In one example, the first and second projections 252, 256 protrude from walls 262, 272 of first and second bodies 250, 254. In some examples, the projections 252, 256 are manufactured from a different material than the first and second bodies 252, 254. In some examples, the first and second bodies 250, 254 can be constructed of a plastic material and the projections 252, 256 are manufactured from metal.

While the engagement features 149, 249 of the suppressor tool 148,248 are shown as projections, it is considered within the scope of the present application that the recesses 110 of the barrel attachment portion 102, body portion(s) 104, and cap portion 106 may be projections and the engagement features 149, 249 of the suppressor tools 148, 248 may be recesses.

The various examples described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A modular suppressor kit comprising:

a modular suppressor comprising:

a barrel attachment portion having a central passage, the barrel attachment portion being configured to attach to a firearm barrel;

a cap portion having a central passage; and two or more body portions, each body portion having an internal baffle structure and an expansion chamber, and each body portion being attachable to, and separable from, each other and at least one of the barrel attachment portion and the cap portion, wherein the two or more body portions define a central passage being alignable with the central passage of the barrel attachment portion and the central passage of the cap portion; wherein at least one body portion comprises a plurality of exterior recesses spaced apart from an end of the body portion that is external and nearest the cap portion when the modular suppressor is assembled; and a suppressor tool having at least one projection configured to engage at least one exterior recess of the at least one body portion;

wherein each recess is spaced apart from an end of the body portion that is distal the barrel attachment portion when the modular suppressor is assembled.

2. The modular suppressor kit of claim 1, wherein the barrel attachment portion, cap portion and each body portion are generally cylindrical.

3. The modular suppressor kit of claim 1, wherein the at least one projection of the suppressor tool prevents relative movement between the suppressor tool and at least one of the barrel attachment portion, cap portion, and body portions when the suppressor tool is engaged with at least one of the barrel attachment portion, cap portion, and body portion.

4. The modular suppressor kit of claim 1, wherein the plurality of recesses are sized to receive the at least one projection.

5. The modular suppressor kit of claim 1, wherein the suppressor tool comprises:

a first and a second body mated with one another, wherein the at least one projection is positioned on a wall of at least one of the first and second bodies.

6. The modular suppressor kit of claim 5, wherein the first and second bodies combine to form a cylindrical passage when the suppressor tool is in a closed position.

7. The modular suppressor kit of claim 5, wherein the cap portion comprises an exterior projection surrounding the central passage.

8. The modular suppressor kit of claim 7, wherein the suppressor tool has a cap recess that is sized to receive the exterior projection of the cap portion so as to prevent relative movement between the suppressor tool and the cap portion when the cap recess receives the exterior projection.

* * * * *